US007112124B1

(12) United States Patent
Naples

(10) Patent No.: US 7,112,124 B1
(45) Date of Patent: Sep. 26, 2006

(54) ROTARY BLADE SHARPENER

(76) Inventor: Donald Naples, 419 Tucker St., Healdsburg, CA (US) 95448

( * ) Notice: Subject to any disclaimer, the term of this patent is extended or adjusted under 35 U.S.C. 154(b) by 76 days.

(21) Appl. No.: 10/629,257

(22) Filed: Jul. 28, 2003

(51) Int. Cl.
*B24B 1/00* (2006.01)
*B24B 9/00* (2006.01)

(52) U.S. Cl. ..... 451/279; 451/45; 451/293; 451/367; 451/387

(58) Field of Classification Search ..... 451/45, 451/278, 279, 293, 321, 322, 367, 371, 387, 451/405, 451, 452
See application file for complete search history.

(56) References Cited

U.S. PATENT DOCUMENTS 1,956,686 A * 5/1934 Kane ..... 451/279
2,699,791 A * 1/1955 Hansen ..... 132/76.4
2,762,175 A * 9/1956 Kramer ..... 451/45
3,054,229 A * 9/1962 Peasley et al. ..... 451/273
3,190,047 A * 6/1965 Villalobos ..... 451/41
3,703,739 A * 11/1972 Young et al. ..... 15/230.17
4,222,204 A * 9/1980 Benner ..... 451/494
4,259,814 A 4/1981 Glaser et al.
4,850,157 A * 7/1989 Holmstrand ..... 451/278
4,961,288 A 10/1990 Ketteringham
4,996,797 A 3/1991 Laughton
5,157,870 A * 10/1992 Pike ..... 451/273
5,295,328 A * 3/1994 Olbrich ..... 451/273
5,545,081 A * 8/1996 Haffely et al. ..... 451/367
5,582,542 A * 12/1996 Stein ..... 451/367
5,967,882 A * 10/1999 Duescher ..... 451/57
6,676,495 B1 * 1/2004 Siemers et al. ..... 451/278

* cited by examiner

*Primary Examiner*—Timothy V. Eley
(74) *Attorney, Agent, or Firm*—Berkeley Law and Technology Group, LLC

(57) ABSTRACT

A rotary blade sharpener is comprised of a motorized platen positioned in a housing with a surrounding wall and an open top. An abrasive sheet with an adhesive bottom surface is adhered to a disc, which is tightened to the platen by a knob. The disc is color coded to indicate the grit of the abrasive sheet. An adjustable support rack is hinged to the housing above the platen. A jig is positioned on the rack and arranged to slide side to side thereon. The jig is arranged to receive and securely hold a blade and position it against the abrasive sheet. The rack is adjustable to position a beveled front end of the blade flat on the abrasive sheet. A lubricant container with a drip tube is attached to the housing. A cutout in the surrounding wall is arranged to enable grinding a flat side of the blade.

18 Claims, 4 Drawing Sheets

ROTARY BLADE SHARPENER

BACKGROUND OF THE INVENTION

1. Field of the Invention

The invention broadly relates to grinders and sharpeners for blades and chisels.

2. Prior Art

A wood working blade, such as a chisel blade or a plane blade, includes a beveled front end and a flat back which must both be perfectly flat. The flatness of the beveled front end is particularly important for a plane blade, because even a slightly curved surface will prevent the sharp edge from making full contact with the work piece. The back must also be perfectly flat at least at the front end to cooperate with the beveled front end to make a straight cutting surface.

Woodworking blades are often sharpened with the rim of a grinding wheel. However, the grinding wheel makes a concave cutting edge which weakens the edge. Therefore, Japanese tools should never be sharpened with a grinding wheel. Another type of grinding platen provides a flat side for grinding. However, the high rotation rate of several hundred r.p.m. may heat the blade enough to lose its temper. Also, it is very difficult to hold the blade by hand at the correct angle to grind a perfectly flat surface. Any wobbling will result in a curved surface on the blade. Further, lubricant used on the platen may be flung outward towards the user and the surrounding area.

BRIEF SUMMARY OF THE INVENTION

Objects of the present rotary blade sharpener are to:

- sharpen various types of blades, particularly plane and chisel blades;
- support the blade at an adjustable angle for grinding a perfectly flat surface on the blade;
- provide interchangeable abrasive discs of different grades;
- provide interchangeable abrasive discs which are color coded to indicate their grade;
- enable the blade to move across the surface of the abrasive disc for evening wearing the abrasive disc;
- automatically dispense lubricant onto the abrasive disc;
- prevent the lubricant from flinging outside the sharpener;
- enable grinding the back side of the blade; and abrade other objects.

The rotary blade sharpener is comprised of a rotatable platen positioned in a housing with a surrounding wall and an open top. The platen is driven by a motor under the housing to rotate about a vertical axis. An abrasive sheet with an adhesive bottom surface is adhered to a disc, which is tightened to the platen by a knob. The disc is color coded to indicate the grit of the abrasive sheet. An adjustable support rack has a bottom end hinged to the housing at a position above the platen, and a top end supported by a vertical rod movably positioned through a clamp attached to the housing. A jig is positioned on the rack and arranged to slide side to side thereon. The jig is arranged to receive a blade and position it against the abrasive sheet. The rack is adjustable to position the blade at a desired angle on the abrasive sheet. A lubricant container is attached to the housing. A tube extending from the container is positioned to dispense lubricant onto the abrasive sheet. A cutout in the surrounding wall is arranged to enable grinding the flat side of the blade.

DRAWING REFERENCE NUMERALS

| | |
|---|---|
| 10. Sharpener | 11. Platen |
| 12. Housing | 13. Motor |
| 14. Switch | 15. Disc |
| 16. Hole | 17. Axle |
| 18. Knob | 19. Abrasive Sheet |
| 20. Adhesive Bottom | 21. Lubricant Container |
| 22. Tube | 23. Valve |
| 24. Bottom | 25. Wall |
| 26. Open Top | 27. Support Assembly |
| 28. Rack | 29. Rod |
| 30. Clamp | 31. Side |
| 32. Rails | 33. Jig |
| 34. Hook | 35. Plate |
| 36. Flat Portion | 37. Cutout |
| 38. Frame | 39. Knob |
| 40. Molding | 41. Cutout |
| 42. Chisel | 43. Blade |
| 44. Beveled Side | 45. Flat Side |
| 46. Handle | 47. Beveled Front End |
| 48. Blade Holder Assembly | 49. Clamp |

DETAILED DESCRIPTION OF THE INVENTION

FIG. 1

Figure 1:
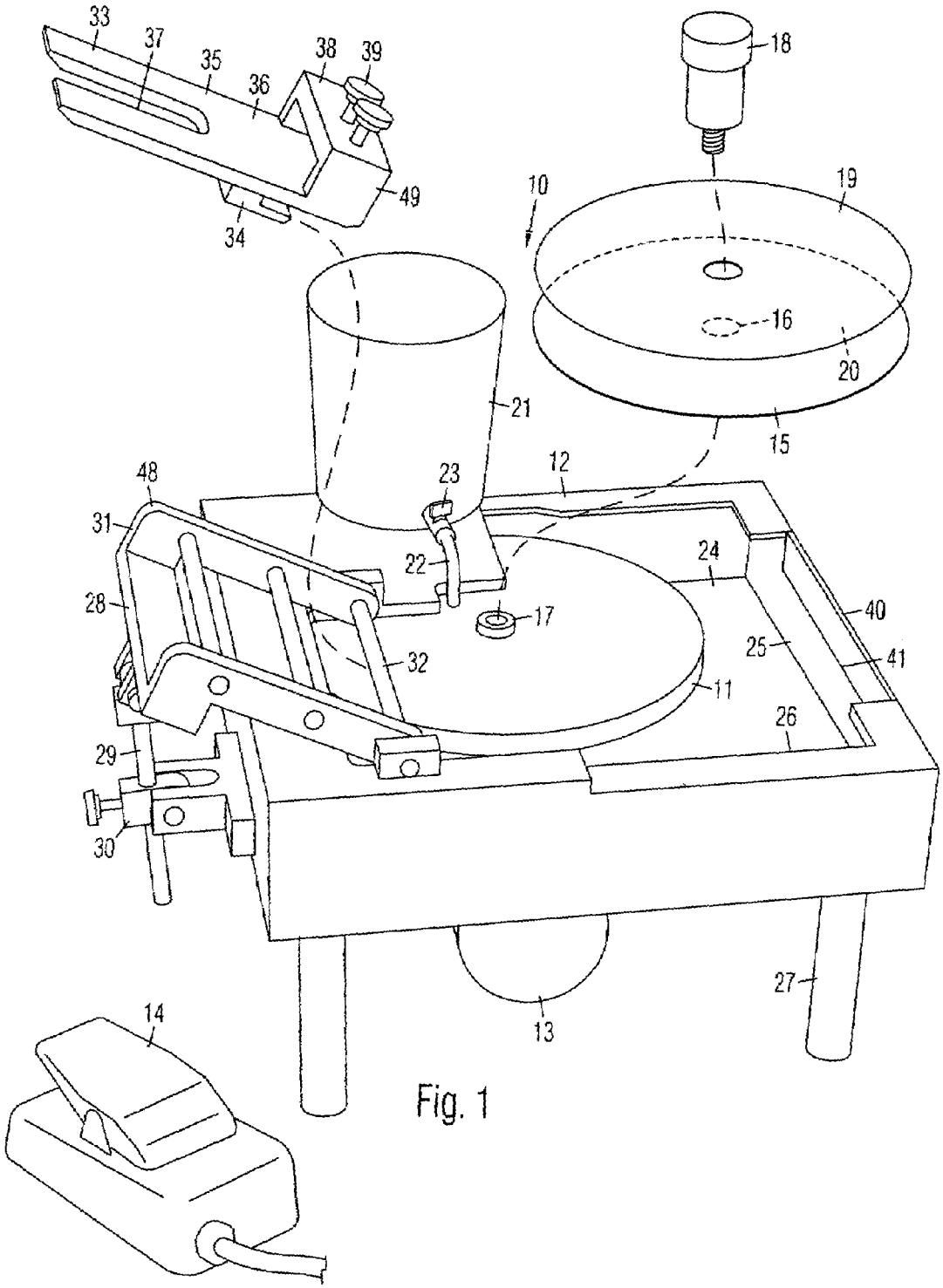
FIG. 1 is an exploded perspective view of the present rotary blade sharpener.

A preferred embodiment of a rotary blade sharpener 10 shown in FIG. 1 is comprised of a platen 11 positioned in a housing 12. A right angled motor 13 controlled by a foot switch 14 is attached under housing 12. Motor 13 is connected to platen 11 for rotating it about a vertical axis at about 100 to 200 revolutions per minute. A detachable disc 15 with a center hole 16 is for being tightened to an axle 17 on top of platen 11 by a knurled disc knob 18. An abrasive sheet 19 has a pressure sensitive adhesive bottom surface 20 for sticking on top of disc 15, which is color coded to indicate the grit of sheet 19. Disc 15 is slightly larger than platen 11 to enhanced grip during removal. Different abrasive sheets of different grits and abrasive materials may be provided. Alternatively, abrasive sheet 19 may be adhered directly to platen 111 without disc 15.

A lubricant container 21 is attached to housing 12. A tube 22 extending from container 21 is positioned to drip lubricant onto abrasive disc 15 at a rate controlled by a valve 23. Housing 12 includes a bottom 24, a surrounding wall 25 extending above platen 11, an open top 26, and a support assembly 27. Surrounding wall 25 is arranged to completely surround platen 11 for catching lubricant flung from abrasive disc 15.

A blade holder assembly 48 is positioned over platen 11 for holding a blade (not shown), and is comprised of an adjustable support rack 28 and a jig 33. Adjustable support rack 28 includes a bottom end hinged to housing 12 at a position directly over platen 11, and a top end supported by a vertical rod 29 movably positioned through a clamp 30 attached to housing 12. Rack 28 is comprised of sides 31 connected by transverse rails 32. A jig 33 is for being positioned on rack 28, and includes a hook 34 on its bottom for hooking onto a selected rail 32. Additional jigs of different sizes may be provided for holding different size blades, and are arranged for hooking onto different rails. For example, a larger jig is hooked onto the lowest rail and rests on the highest rail, and a smaller jig is hooked onto the lowest rail and rests on the middle rail.

Jig 33 is comprised of a plate 35 with a flat portion 36 for supporting the blade, a cutout 37 for providing clearance for a handle of the blade, and a clamp 49 on a top side comprising a frame 38 with blade knobs 39 for tightening the blade. Jig 33 is arranged for sliding side to side on rack 28. Jig 33 is for positioning the beveled front end of the chisel blade against abrasive sheet 19 with the blade perpendicular to a radius of platen 11. Rack 28 is adjustable in tilt to position the blade on abrasive sheet 19 at the angle of the beveled front end. Platen 11 is arranged to rotate away from the blade. In this example, platen 11 is arranged to rotate counterclockwise. A molding 40 of a collapsible material in a cutout 41 in surrounding wall 25 may be depressed to enable grinding the back of the blade.

FIG. 2

Figure 2:
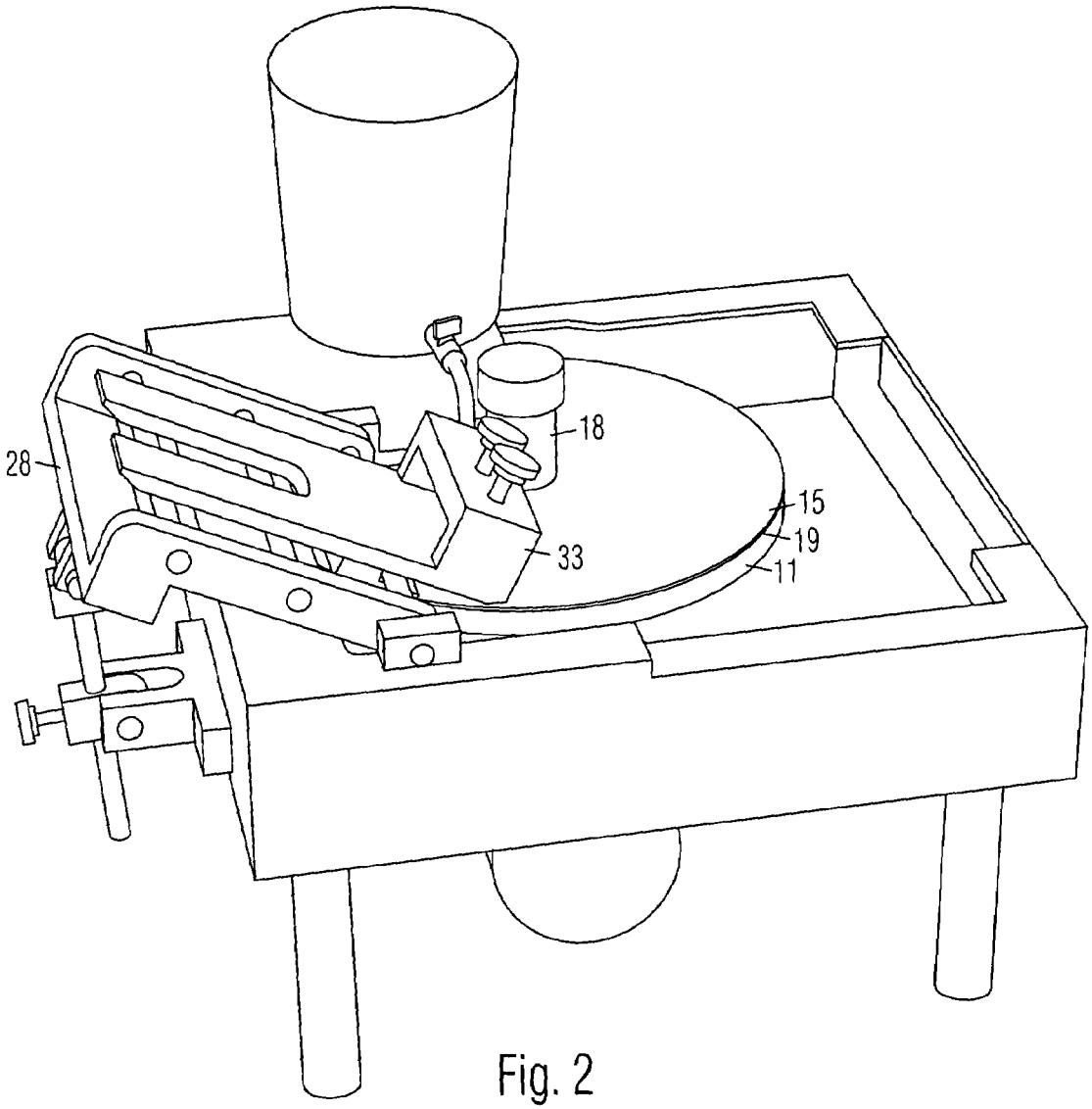
FIG. 2 shows the sharpener assembled.

In FIG. 2, abrasive sheet 19 is attached on top of disc 15, which is attached to platen 11 and secured with knob 18. Jig 33 is positioned on rack 28.

FIG. 3

Figure 3:
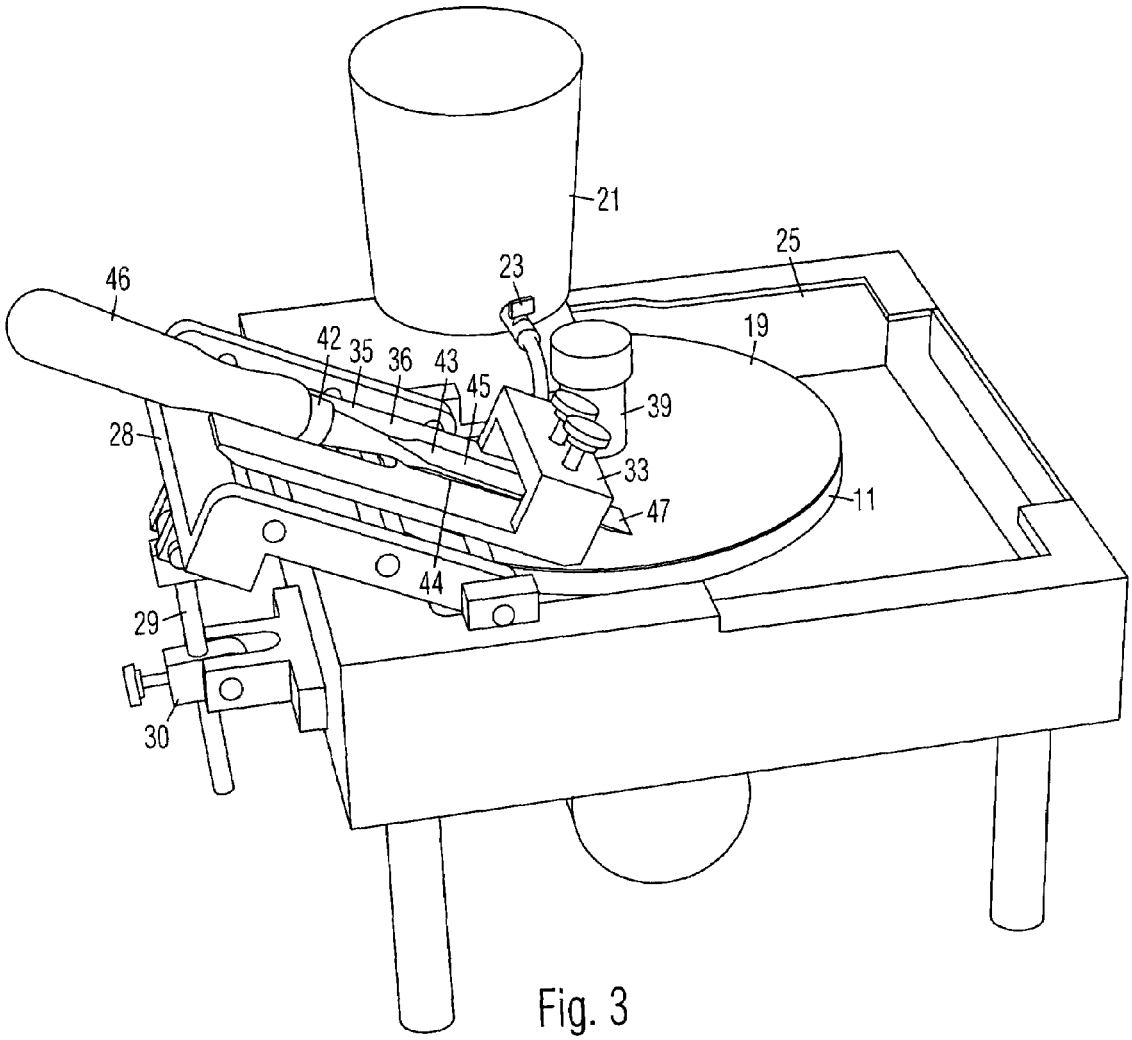
FIG. 3 shows a blade positioned in the sharpener for sharpening a beveled front end.

In FIG. 3, a chisel 42 is positioned in jig 33 wherein a blade 43 thereof is positioned with a beveled side 44 against flat portion 36 of plate 35 and a flat side 45 facing up. A handle 46 of chisel 42 is positioned in cutout 37 of plate 35. Blade 43 is positioned with its beveled front end 47 against abrasive sheet 19, and rack 28 is adjusted in tilt by sliding rod 29 in clamp 30 to position beveled front end 47 flat against abrasive disc 15. Chisel 42 is tightened with knobs 39.

Platen is arranged to rotate at about 100–200 rpm to avoid overheating blade 43 which may otherwise alter its temper. Platen 11 is arranged to rotate away from blade 43 to automatically pull it downward against abrasive sheet 19 to eliminate the need for the user to press it down manually. Jig 33 may be manually moved side to side in rack 28 for evenly wearing abrasive sheet 19.

Valve 23 on lubricant container 21 is opened to dispense a lubricant onto abrasive sheet 19. Lubricant flung outward by platen 11 is caught by surrounding wall 25.

FIG. 4

Figure 4:
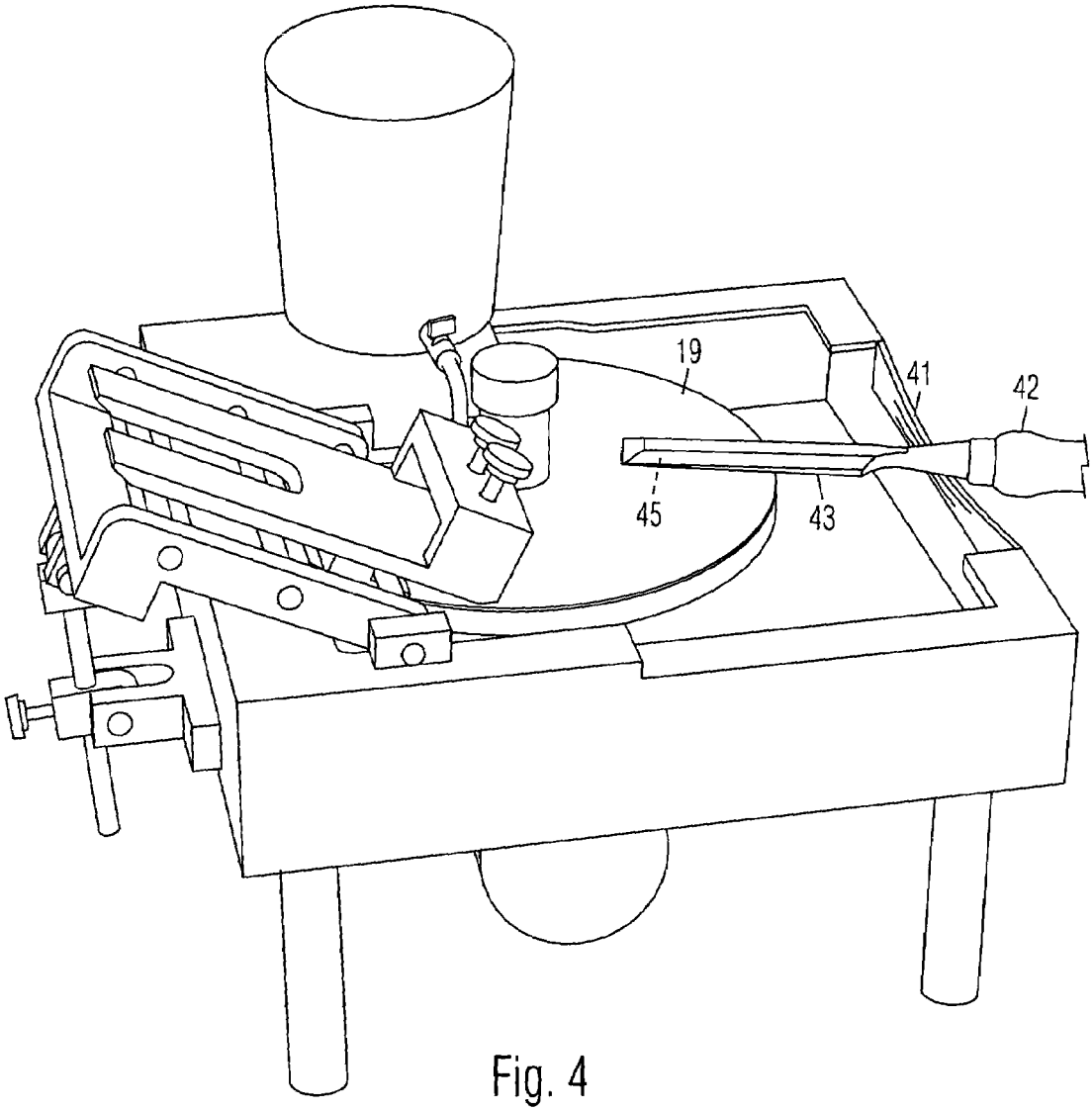
FIG. 4 shows a blade positioned in the sharpener for sharpening a flat back side.

In FIG. 4, the cover on cutout 41 is removed to allow back 45 of blade 43 to be placed flat on abrasive sheet 19 for grinding, wherein handle 42 is positioned through cutout 41.

Although the foregoing description is specific, it should not be considered as a limitation on the scope of the invention, but only as an example of the preferred embodiment. Many variations are possible within the teachings of the invention. For example, the sharpener may be used to sharpen different types of blades in addition to chisel blades. The relative positions of the elements can vary, and the shapes of the elements can vary. Therefore, the scope of the invention should be determined by the appended claims and their legal equivalents, not by the examples given.

I claim:

1. A rotary blade sharpener, comprising:

a housing;

a rotatable platen in said housing arranged to rotate about a vertical axis;

an abrasive sheet on top of said platen;

a blade holder assembly positioned over said abrasive sheet, wherein said blade holder assembly includes a blade clamp for securing a blade against said abrasive sheet, said blade holder assembly is adapted to adjust an angle between said blade and said abrasive sheet, wherein said abrasive sheet includes a pressure sensitive adhesive bottom surface, and further including a disc which is color coded to indicate a grit of said abrasive sheet, wherein said disc is positioned between said abrasive sheet and said platen.

2. The rotary blade sharpener of claim 1, wherein the blade holder assembly is hinged to said housing.

3. A rotary blade sharpener, comprising:

a housing;

a rotatable platen in said housing arranged to rotate about a vertical axis;

an abrasive sheet on top of said platen;

a blade holder assembly positioned over said abrasive sheet, wherein said blade holder assembly includes a blade clamp for securing a blade against said abrasive sheet, said blade holder assembly is adapted to adjust an angle between said blade and said abrasive sheet, further including a surrounding wall completely surrounding said platen and extending above said abrasive sheet for catching lubricant flung from said abrasive sheet, a cutout in said surrounding wall, and a collapsible molding in said cutout, wherein said molding is collapsible for enabling positioning said blade flat on said abrasive sheet through said cutout.

4. The rotary blade sharpener of claim 3, wherein said surrounding wall is removable.

5. The rotary blade sharpener of claim 3, wherein the blade holder assembly is hinged to said housing.

6. A rotary blade sharpener, comprising:

a housing;

a rotatable platen in said housing arranged to rotate about a vertical axis;

an abrasive sheet on top of said platen;

an adjustable support rack hinged to said housing over said platen for adjusting an angle between said adjustable support rack and said platen; and a jig movably positioned on said rack for securing a blade against said abrasive sheet, said jig is movable in said rack for moving said blade radially across said abrasive sheet, wherein said jig is comprised of a plate for supporting said blade, a cutout in said plate for providing clearance for a handle of said blade, and a clamp on said plate for tightening said blade against said plate.

7. A rotary blade sharpener, comprising:

a housing;

a rotatable platen in said housing arranged to rotate about a vertical axis;

an abrasive sheet on top of said platen;

an adjustable support rack hinged to said housing over said platen for adjusting an angle between said adjustable support rack and said platen; and a jig movably positioned on said rack for securing a blade against said abrasive sheet, said jig is movable in said rack for moving said blade radially across said abrasive sheet, wherein said rack is comprised of sides connected by a transverse rail, and said jig includes a hook arranged to hook on said rail.

8. A rotary blade sharpener, comprising:

a housing;

a rotatable platen in said housing arranged to rotate about a vertical axis;

an abrasive sheet on top of said platen;

an adjustable support rack hinged to said housing over said platen for adjusting an angle between said adjustable support rack and said platen; and a jig movably positioned on said rack for securing a blade against said abrasive sheet, said jig is movable in said rack for moving said blade radially across said abrasive sheet, wherein said abrasive sheet includes a pressure sensitive adhesive bottom surface, and further including a disc which is color coded to indicate a grit of said abrasive sheet, wherein said disc is positioned between said abrasive sheet and said platen.

9. A rotary blade sharpener, comprising:

a housing;

a rotatable platen in said housing arranged to rotate about a vertical axis;

an abrasive sheet on top of said platen;

an adjustable support rack hinged to said housing over said platen for adjusting an angle between said adjustable support rack and said platen; and a jig movably positioned on said rack for securing a blade against said abrasive sheet, said jig is movable in said rack for moving said blade radially across said abrasive sheet wherein said housing includes a surrounding wall completely surrounding said platen and extending above said abrasive sheet for catching lubricant flung from said abrasive sheet, a cutout in said surrounding wall, and a collapsible molding in said cutout, wherein said molding is collapsible for enabling positioning said blade flat on said abrasive sheet through said cutout.

10. The rotary blade sharpener of claim 9, wherein said surrounding wall is removable.

11. A rotary blade sharpener, comprising:

a housing including a surrounding wall and an open top;

a platen positioned in said housing below said open top of said surrounding wall;

a removable disc on top of said platen;

an abrasive sheet with a pressure sensitive adhesive bottom surface adhered to said disc, wherein said disc is color coded to indicate a grit of said abrasive sheet; and an adjustable support rack hinged to said housing over said platen for being adjustable in angle, wherein said rack is comprised of sides connected by a transverse rail;

a jig movably positioned on said rack, said jig is comprised of a plate for supporting a blade against said abrasive sheet, a cutout for providing clearance for a handle of said blade, and a blade clamp with knobs for tightening said blade against said plate, said rack is adapted to position said blade on said abrasive sheet, said jig is movable side to side on said rack for moving said blade radially across said abrasive sheet; and a cutout in said surrounding wall for enabling positioning said blade flat on said abrasive sheet through said cutout.

12. The rotary blade sharpener of claim 11, wherein said platen is arranged to rotate away from said blade for pulling said blade against said abrasive sheet.

13. The rotary blade sharpener of claim 11, wherein said disc is larger than said platen to enhance grip during removal of said disc.

14. The rotary blade sharpener of claim 11, further including a motor connected to said platen for rotating said platen at about 100 to 200 rpm for avoiding damaging a temper of said blade.

15. The rotary blade sharpener of claim 11, further including a lubricant container for dispensing a lubricant onto said abrasive sheet at a rate controlled by a valve connected to said container.

16. The rotary blade sharpener of claim 11, wherein said jig includes a hook arranged to hook on said rail.

17. The rotary blade sharpener of claim 11, wherein said surrounding wall is removable.

18. The rotary blade sharpener of claim 11, wherein said platen is arranged to rotate toward said blade.

* * * * *